United States Patent [19]

Sokol

[11] 4,012,036

[45] Mar. 15, 1977

[54] DOCUMENT HOPPER

[75] Inventor: Gary Leo Sokol, Longmont, Colo.

[73] Assignee: International Business Machines Corporation, Armonk, N.Y.

[22] Filed: June 10, 1976

[21] Appl. No.: 694,864

[52] U.S. Cl. ..... 271/215

[51] Int. Cl.[2] ..... B65H 43/04

[58] Field of Search ..... 271/214, 215, 217, 219

[56] References Cited

UNITED STATES PATENTS

| | | | |
|---|---|---|---|
| 2,990,174 | 6/1961 | Kimbrough | 271/215 |
| 3,107,912 | 10/1963 | Fichl | 271/215 |

*Primary Examiner*—Richard A. Schacher

*Attorney, Agent, or Firm*—James H. Barksdale, Jr.

[57] ABSTRACT

A document hopper having a platform which can be lowered and elevated. The platform is operably connected to a rotatable leadscrew through a shoe engaging the threads of the leadscrew. The leadscrew is held against rotation by a pawl engaging a detent about one end of the leadscrew. When so held, the platform is maintained at a determined height. When the pawl is withdrawn from the detent, the weight of the platform against the shoe is sufficient to cause rotation of the leadscrew. Upon rotation of the leadscrew, the platform is lowered. When lowered a desired extent, the pawl is permitted to reengage the detent. Elevation of the platform is manual with the leadscrew rotating and the pawl ratcheting over the detent.

10 Claims, 2 Drawing Figures

DOCUMENT HOPPER

CROSS-REFERENCES TO RELATED APPLICATIONS

U.S. Patent Application Ser. No. 691,764, entitled Document Feeding Apparatus, filed June 1, 1976, having William M. Jenkins as inventor, and assigned to the assignee of this application.

BACKGROUND OF THE INVENTION

1. Field of the Invention

This invention generally relates to document handling after a document has been printed. More specifically, this invention relates to an apparatus for receiving printed documents and controlling the extent of free flight of the documents when fed into the apparatus.

2. Description of the Prior Art

There are numerous envelope and sheet hopper patents and publications in the prior art. In some cases, these envelope and sheet hoppers employ elevator platforms which are power driven by means of a motor, gears, and a leadscrew. In other cases, belt drive systems are utilized. In the majority of instances, motor drives and controls are employed. There are no known hoppers though, which both employ a gravity system for lowering a platform carrying stack of envelopes or sheets and require an operator to raise the platform to its uppermost position following unloading of the stack.

U.S. Pat. Nos. 2,950,107; 2,992,820; 3,008,709; 3,062,533; 3,062,534; 3,123,355; 3,227,443; 3,301,551; 3,402,928; 3,458,187; 3,664,663; 3,687,448; 3,759,509; 3,768,806; 3,806,112; 3,819,174; and 3,883,132; IBM Technical Disclosure Bulletin, October 1965, Vol. 8, No. 5, page 791 entitled "Document Platform Raising Device"; and British patent 1,122,627 entitled "Sheet Feed Mechanism", filed Sept. 2, 1965, and issued Aug. 7, 1968 were considered in conjunction with this invention. Although none of the above art is considered particularly pertinent to the claims attached hereto, a representative portion of the above mentioned art will be discussed. The above-mentioned IBM TDB describes a document platform raising device which is actuated by a switch mechanism having an arm resting against the upper most document of a stack. When the switch is tripped, a logic mechanism is moved from its latching position, allowing a continously rotating cam to apply drive power to a chain elevator mechanism. The above-mentioned British patent relates to a sheet stack advancer for a sheet feed mechanism in which the stack of sheets is periodically advanced to a predetermined height so that the top most sheet of the stack is in proper operable relation to an associated sheet separation and advancing mechanism. An electric motor is operatively connected to the platform to drive the platform in one direction to raise it and in another direction to lower it. U.S. Pat. No. 2,950,107 relates to an elevator pallet for a continuous top sheet feed apparatus. The pallet is supported by cables which are in turn connected to a winding drum. The drum is rotated by a reversable electric motor supported on a frame. U.S. Pat. No. 3,301,551 relates to a paper stack advancing mechanism for use in a reproduction machine. An automatic control device maintains the level of the paper stack in the paper feed mechanism at a predetermined height so that the top most sheet may be readily forwarded by a sheet feed apparatus. U.S. Pat. No. 3,768,806 relates to apparatus for regulating the position of a platform upon which sheets of material are stacked in order that the top most sheet may be fed and the stack may be replenished.

U.S. Pat. No. 3,883,132 is directed toward an automatic feeding control for a duplicating machine. In this patent a latch lever is employed which rests on the top sheet of a stack of sheets which are to be fed. As feeding progresses and the stack of sheets decreases in height, a latch lever is operable to terminate feeding. Following loading or replenishing of the supply of paper and movement of the platform upward such that the latch lever is again raised to the desired level, feeding automatically commences.

From the above, there is no disclosure or teaching of a hopper employing gravity for lowering a document platform and requiring manual raising for resetting for continued acceptance of documents. With this invention, the necessity for drive motors, elaborate controls, and expensive mechanism is overcome.

SUMMARY OF THE INVENTION

A document hopper is provided having a tilted platform which can be lowered and elevated for receiving documents. The documents are fed into the hopper and permitted to free fall and come to rest on the platform. The platform is first positioned at a predetermined height such that a maximum free fall distance is not exceeded. The maximum free fall distance is the distance from the point of an incoming document to the point the incoming document comes to rest on either the platform or a stack of documents on the platform. This distance is not to be exceeded in order that documents be received in an orderly manner. As subsequent documents are fed into the hopper, the platform is periodically lowered to an extent not to exceed the maximum free fall distance. With the platform at a position above its lowermost position, it is maintained in part by a shoe carried by structure connected to the platform and cooperating with a leadscrew. A pawl cooperating with a detent connected to the leadscrew also serves to maintain the platform. Upon release of this pawl from the detent, lowering of the platform takes place. The weight of the platform causes rotation of the leadscrew through the shoe. Upon reengagement of the pawl with the detent, lowering of the platform is terminated. Elevation of the platform for resetting and continued acceptance of documents is manual. The pawl will ratchet over the detent upon reverse rotation of the leadscrew caused by the shoe.

DESCRIPTION OF THE PREFERRED EMBODIMENT

Figure 1:
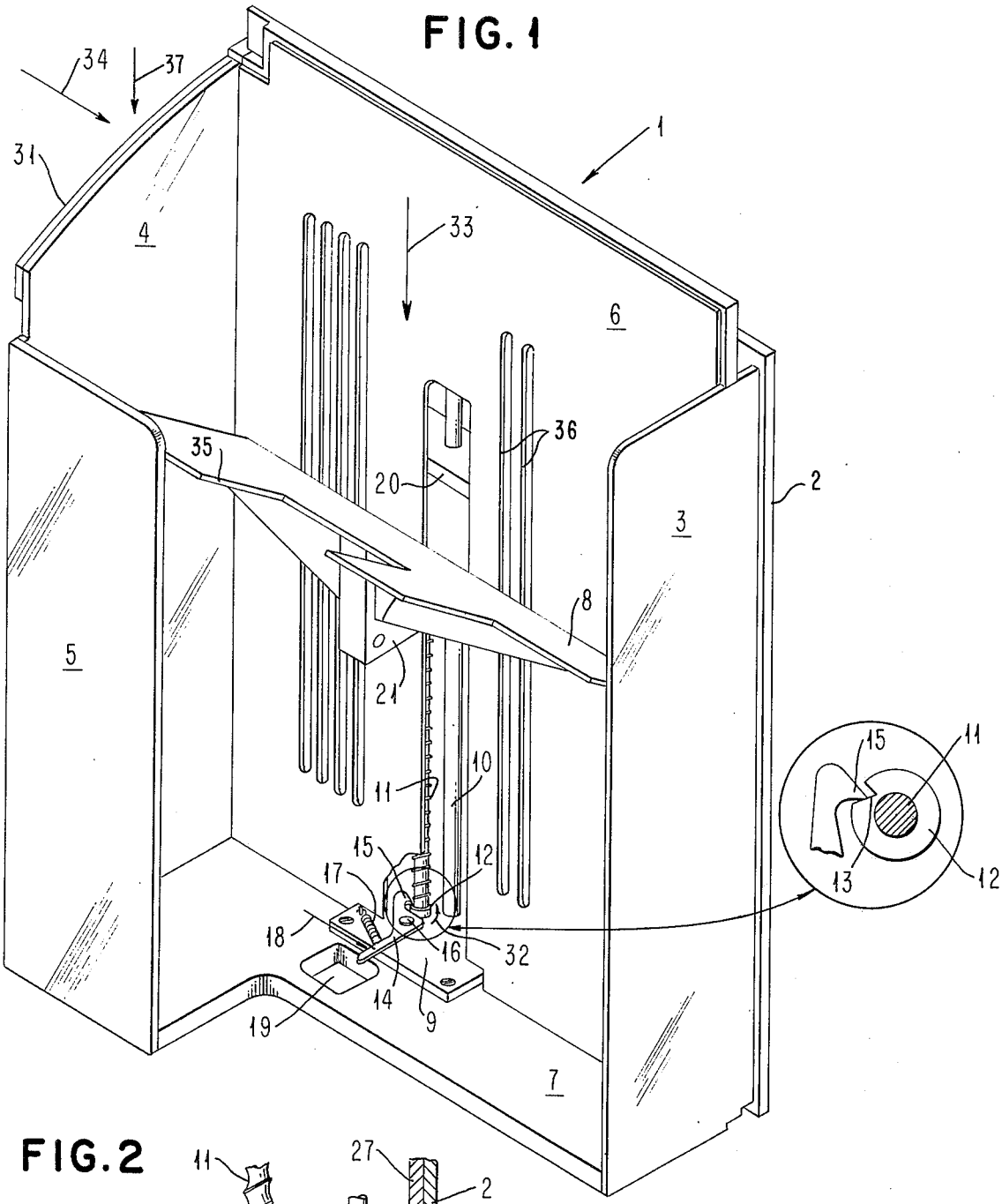
FIG. 1 is a perspective view of a document hopper according to this invention.

For a more detailed understanding of the invention, reference is first made to FIG. 1. In FIG. 1 there is shown the document hopper of this invention generally denoted by reference numeral 1. The document receiving portion of hopper 1 has side plates 3 and 4, front plate 5, backplate 6, and tilted platform 8. Side plates 3 and 4, front plate 5, and backplate 6 tend to guide a document toward tilted platform 8 when fed into hopper 1 along the direction of arrow 34. With a document being fed into hopper 1 and over top 31 of sideplate 4 along the direction of arrow 34, it is permitted to fall in the direction of arrow 33 and come to rest on tilted platform 8. The feeding of documents over top 31 can be through the right angle feeding means disclosed in the above cross-referenced application.

Platform 8, as shown, is in its uppermost position. In this position, it is to be assumed that the distance between top 31 of side plate 4 and platform 8 is the maximum allowable free fall distance for a document in the direction of arrow 33. If the distance between top 31 and platform 8 is too great, a document will tend to float and glide an undue extent and become skewed or misaligned during landing on platform 8. For each contemplated configuration of hopper 1, there is a determinable distance through which a document can fall and still assume proper alignment upon landing on tilted platform 8. The tilting of the platform, and the provision of openings 36 for air escape permit this distance to be increased somewhat. This tilt of platform 8 is to facilitate the stacking and alignment of documents one on top of another.

As documents continue to be fed over top 31 and stacked, one on top of another, on platform 8, platform 8 must be lowered. The reason for this is that the height of the stack of documents on platform 8 will eventually be higher than the top of front plate 5 and/or end plate 3. In determining the height of a stack of documents on platform 8, a sensor 37 is utilized. When the stack reaches a determined height and trips the sensor, a solenoid, or other suitable means, will act against crank 14 in the direction of arrow 18. The solenoid is positioned within opening 19. Upon rotation of crank 14 about pivot 16 in a counterclockwise direction, pawl 15 will be brought out of engagement with detent 13 in hub 12. Hub 12 is rigidly secured to the lower portion of leadscrew 11.

Figure 2:
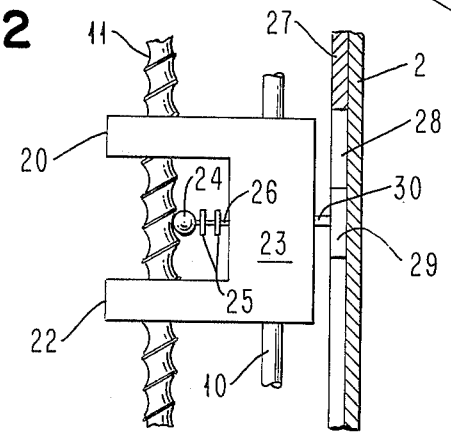
FIG. 2 is a broken away sectional view of the connection between the leadscrew and the document platform.

Refer next to FIG. 2 in conjunction with FIG. 1. Platform 8 has support 21 which is connected to yolk 22 of carrier 23. Carrier 23 carries shoe 24 through shaft 26 which can be threaded about its right end and turned in and out in a cooperating opening in carrier 23 for adjustment purposes. Shaft 26 has adjustment and lock nuts 25 for adjusting the tolerance between the threads of leadscrew 11 and shoe 24. This tolerance is adjusted such that platform 8 will be maintained in position under the load of any documents stacked thereon, and elevation and lowering of platform 8 will cause rotation of leadscrew 11 without binding. That is, proper adjustment will prevent shoe 24 from ratcheting over the threads of leadscrew 11 when platform 8 is fully loaded. Carrier 23 has a support rod 30 connecting it to a guide member 29. Guide member 29 rides within a guide slot 28 formed by hopper back 2 and intermediate plate 27. In addition to guide member 29 and guide slot 28, carrier 23 is guided by guide rod 10 along which carrier 23 is freely slideable.

Referring again to FIG. 1, when pawl 15 is brought out of engagement with detent 13, the weight of platform 8 will cause rotation of leadscrew 11 through shoe 24. When platform 8 has been lowered a sufficient extent not to exceed the maximum allowable free fall distance, the solenoid utilized for rotating crank 14, is deactivated. This permits crank 14 to restore under the influence of spring 17. This will result in pawl 15 reengaging detent 13 and will cause the lowering of platform 8 to be terminated. The shape of detent 13 inhibits rotation in the direction of arrow 32 when engaged by pawl 15. This shape does not prevent reverse rotation of leadscrew 11, though.

During the lowering of platform 8 upon rotation of leadscrew 11 in the direction of arrow 32, platform 8 will eventually attain its lowermost position. When the lowermost position is reached, subsequent incoming documents will cause repeated tripping of the sensor 37. This will result in an operator being signaled by a buzzer or other suitable means. When the operator is thus signaled, the documents resting upon platform 8 are to be manually removed. Slot 35 is for facilitating the removal of documents from platform 8.

With platform 8 being at its lowermost position, and all documents removed therefrom, the operator can grasp support 21 and manually raise platform 8 to its uppermost position. During the raising of platform 8, shoe 24 will cause reverse rotation of leadscrew 11 with pawl 15 ratcheting over detent 13.

With the above in mind, operation begins with the operator assuring that platform 8 has been elevated manually to its uppermost position. Documents, such as printed envelopes, are then sequentially fed over top 31 in the direction of arrow 34. Each document fed over top 31 is permitted to fall in the direction of arrow 33 into hopper 1 and come to rest on platform 8. Eventually, there will be a stack of documents on platform 8 having a stack height requiring the lowering of platform 8 in order that hopper 1 can accept more documents. This will be sensed by sensor 37 which will cause activation of a solenoid to momentarily rotate crank 14. The momentary rotation of crank 14 is to permit leadscrew 11 to rotate a predetermined rotational distance and platform 8 to be lowered a predetermined distance. When crank 14 is rotated, pawl 15 is brought out of engagement with detent 13. This releases leadscrew 11 for rotation by shoe 24 under the influence of the weight of platform 8. When platform 8 has been lowered a desired extent, which can be one revolution of leadscrew 11, the solenoid is deactivated. Crank 14 will restore under the influence of spring 17 and pawl 15 will reengage detent 13. This will stop rotation of leadscrew 11 and terminate the lowering of platform 8. Thereafter, when hopper 1 has been almost completely filled with a stack of documents and platform 8 is in its lowermost position, sensor 37 will be repeatedly tripped by subsequent incoming documents. This will cause the operator to be alerted. The operator procedure then is to remove the stack of documents from hopper 1 and manually raise platform 8 to its uppermost position. During the elevation of platform 8, shoe 24 will cause reverse rotation leadscrew 11 with pawl 15 ratcheting over detent 13.

In summary, a document hopper is provided having a tilted platform which can be lowered and elevated for receiving documents. The documents are fed into the hopper and permitted to free fall and come to rest on the platform. The platform is first positioned at a height such that a maximum free fall distance is not exceeded. The maximum free fall distance is the distance from the point of an incoming document to the point the incoming document comes to rest on either the platform or a stack of documents on the platform. This distance is not to be exceeded if documents are to be received in an orderly manner. As subsequent documents are fed into the hopper, the platform is periodically lowered to an extent not to exceed the maximum free fall distance.

With the platform at a position above its lowermost position, it is maintained in part by a shoe carried by structure connected to the platform and cooperating with a leadscrew. A pawl cooperating with a detent connected to the leadscrew also serves to maintain the platform. Upon release of this pawl from the detent, lowering of the platform takes place. The weight of the platform causes rotation of the leadscrew through the shoe. Upon reengagement of the pawl with the detent, lowering of the platform is terminated. Elevation of the platform for resetting and continued acceptance of documents is manual. The pawl will ratchet over the detent upon reverse rotation of the leadscrew caused by the shoe.

While the invention has been particularly shown and described with reference to a particular embodiment, it will be understood by those skilled in the art that various changes in form and detail may be made without departing from the spirit and scope of the invention.

What is claimed is:

1. A hopper for receiving documents in an orderly manner when sequentially fed thereinto, said hopper comprising:

a. a platform upon which said documents are stacked when fed into said hopper;

b. a leadscrew operably connected to said platform and rotatable thereby; and c. means for releasing said leadscrew for rotation in one direction for lowering said platform under the weight of said platform for acceptance of additional documents in said hopper.

2. A hopper according to claim 1 wherein said leadscrew releasing means includes means for releasing said leadscrew for rotation a predetermined rotational distance to allow said platform to be lowered a predetermined distance.

3. A hopper according to claim 1 including sensor means for determining when said platform is to be lowered for accepting said additional documents.

4. A hopper according to claim 3 wherein said leadscrew is operably connected to said platform through a shoe which is in engagement with, and follows the threads of said leadscrew upon rotation thereof.

5. A hopper according to claim 4 wherein said leadscrew releasing means includes a pawl and a detent.

6. A hopper according to claim 5 wherein said detent is connected to said leadscrew.

7. A hopper according to claim 6 wherein said detent is structured to permit said leadscrew to be rotated in a second direction when said platform is elevated.

8. A hopper according to claim 7 wherein said platform is positioned in said hopper.

9. A hopper according to claim 8 including guide means for guiding said platform up and down within said hopper.

10. A hopper according to claim 9 wherein said platform is tilted.

* * * * *